US005430915A

United States Patent [19]

Ueda et al.

[11] Patent Number: 5,430,915

[45] Date of Patent: Jul. 11, 1995

[54] APPARATUS FOR SPREADING RECTANGULAR CLOTH PIECES

[75] Inventors: Atsushi Ueda; Hidetoshi Ishihara; Koichi Jinno; Kazuo Kitajima; Toshio Hattori; Kimiharu Fujihashi, all of Nagoya, Japan

[73] Assignee: Mitsubishi Jukogyo Kabushiki Kaisha, Tokyo, Japan

[21] Appl. No.: 49,673

[22] Filed: Apr. 16, 1993

[30] Foreign Application Priority Data

Apr. 20, 1992 [JP] Japan ..... 4-125379
Nov. 20, 1992 [JP] Japan ..... 4-333812
Nov. 26, 1992 [JP] Japan ..... 4-337855

[51] Int. Cl.[6] ..... D06C 3/00; D06F 67/04

[52] U.S. Cl. ..... 26/51; 26/87; 38/143

[58] Field of Search ..... 26/51, 51.5, 52, 75, 26/87, 51.3, 71, 74, 79; 38/8, 12, 14, 16, 143; 198/571, 572, 575, 577, 689.1, 751; 271/225, 198, 197

[56] References Cited

U.S. PATENT DOCUMENTS 1,837,408 12/1931 Chett ..... 26/18.5
1,912,466 6/1933 Remington .
3,414,997 12/1968 Henry ..... 38/143
3,464,131 9/1969 McCable ..... 38/143
3,564,738 2/1971 Batzdorff et al. ..... 38/143
3,568,342 3/1971 Betsch ..... 38/143
3,672,249 6/1972 Sasaki ..... 26/70
3,735,512 5/1973 Ross ..... 38/143
3,772,808 11/1973 Behn ..... 38/143
4,017,722 4/1977 Swanson ..... 26/51.5
4,053,967 10/1977 Mair ..... 38/143
4,303,189 12/1981 Wiley et al. ..... 26/51.5
4,760,626 8/1988 Lonner et al. ..... 26/75
4,882,006 11/1989 Seki ..... 26/51
4,967,495 11/1990 Weir ..... 38/143
5,179,795 1/1993 Nakamura et al. ..... 38/143

FOREIGN PATENT DOCUMENTS 2307907 2/1982 France .
2652095 3/1991 France .
149221 8/1984 Japan .
9198 1/1992 Japan .
4009198 1/1992 Japan .
2221226 1/1990 United Kingdom ..... 138/143

*Primary Examiner*—Clifford D. Crowder
*Assistant Examiner*—Amy B. Vanatta
*Attorney, Agent, or Firm*—McGlew and Tuttle

[57] ABSTRACT

In a cloth piece spreading apparatus which carries out a process in which, after a corner $C_1$ of a rectangular cloth piece 15 and a position Ya on the side of the cloth piece which includes this corner $C_1$ are gripped by a movable gripper 16 to which there are attached two clips 17, and the cloth piece 15 is suspended naturally, the cloth piece 15 is pulled by the gripper 16 and is moved horizontally to the upper surface of a bench 35, which consists of a belt conveyor and the like, while undergoing contact resistance with a convex shaped front edge portion 36 of the bench 35, and is then pulled up onto the bench 35, there is provided a suction duct 47 having numerous suction holes 48 in the half the surface of the cloth edge side of the cloth pulling path on bench 35.

9 Claims, 13 Drawing Sheets

APPARATUS FOR SPREADING RECTANGULAR CLOTH PIECES

FIELD OF THE INVENTION AND RELATED ART STATEMENT

A conventional apparatus which grips the edge of one corner of a rectangular cloth piece, pulls it onto a mounting base, and then spreads open one side of the cloth piece, has been proposed in Japanese Patent Provisional Publication (Kokai) No. 4-9198. This conventional apparatus will be explained with reference to FIGS. 12 through 17.

The conventional edge setting apparatus shown in FIGS. 12 through 16 is used to set the edges of a rectangular cloth piece Y such a sheet as that shown in FIG. 17. This apparatus basically comprises a rectangularly shaped three dimensional frame 1 in which frame materials are assembled into front and rear, right and left, and top and bottom parts, and which has a rather large length in the fore to aft direction A (considerably longer than the entire length of the longer side of the rectangular cloth Y to be processed); a movable body 2 which is disposed to the upper portion of the frame 1 and which is freely movable forward and back in the fore to aft direction, shown by the arrow A, of the frame; a cloth corner holding means 22 and a cloth edge holding means 23 which are provided at two horizontal positions spaced at a given interval from each other to the right and left of said movable body 2, and which hold a corner $C_1$ of the rectangular cloth piece Y and a portion of the edge Ya thereof which is adjacent to the corner $C_1$; a movable body drive device 3 which transfers the movable body 2 within a range which extends from a cloth holding position P at the front of the frame to a pulled cloth position Q at the rear of the frame; a bench 4 which is mounted on the frame 1 and which supports from below the rectangular cloth piece Y which is pulled toward the rear of the frame; a conveyor 5 which forms a part of the bench 4; a conveyor drive device 6 which runs the conveyor 5 in the forward or reverse direction; a lateral edge detecting device 71 which detects the lateral edge Yb of the edge forming side of the rectangular cloth piece Y; a final edge detecting device 72 which similarly detects the final edge Yc of the rectangular cloth piece Y; and a controller 10 which controls the operation of the edge forming apparatus.

A guide rail 11 is installed to the upper portion of frame 1 at a position centered between the left and right sides of the frame 1 and extending along the fore to aft direction A of the frame. The movable body 2 is guided by this guide rail 11 so as to freely move freely back and forth in the fore to aft direction of the frame. The range of movement in the fore-aft direction of this movable body 2 is set to be greater than the range extending from cloth piece holding position P, where, as shown in FIG. 12, the movable body 2 is at the front of the frame and the rectangular cloth piece Y is held by each holding means 22, 23 to the withdrawn cloth position Q, where, as shown in FIG. 16, the movable body 2 is at the rear of the frame and the rectangular cloth piece Y is completely pulled up on to the bench 4.

Further, the movable body 2 is formed from downward hanging plates 21, 21, each of which are respectively bent downward, and which are formed to both the left and right sides of a level plate 20 which has a length approximately equivalent to the width across a person's shoulders (i.e., a length of approximately 40 to 60 cm). One each of holding means 22,23 for holding the cloth piece are attached to the front end of each of these downward hanging plates 21,21. Additionally, as seen from the front side of the frame, holding means 22 positioned on the right is for holding the corner $C_1$ of the cloth piece, and holding means 23 positioned on the left is for holding the edge Ya of the cloth piece. Clip-on air chucks which operate by means of compressed air are employed in each holding means 22, 23.

A movable body drive device 3 has sprockets 32,32 which are provided respectively to the front and rear of the frame 1; a chain 33 having ends and installed between each of the sprockets 32,32; and a motor 31 which rotates one of the sprockets 32 in the forward or reverse direction. One end of the chain 33 is wound around the front sprocket 32 and then fixed to the movable body 2, while the other end of the chain 33 is wound around the rear sprocket 32 and then fixed to the movable body. Accordingly, by means of rotating the sprocket 32 to the right or to the left using the motor 31, this movable body drive device 3 can move the movable body 2 back and forth along the guide rail 11.

Moreover, the bench 4 is provided in a position slightly lower in height than the position of each of the holding means 22, 23 in their advancing and retreating movements. The bench 4 has a front base plate 41 which is comparatively short in the fore to aft direction; a rear base plate 43 which is provided continuous with the rear end of the aforementioned front base plate 41; and a conveyor 5 which can run horizontally forward or backward in the left to right direction of the frame and which is provided at a position near the rear end of the aforementioned front base plate 41. A conveyor 5 is formed of belts 52, 52, a total of four of which form a set and which are wrapped between left and right pairs of rolls 51, 51. An appropriate interval of space S is provided between each of the belts 52,52. Additionally, the running portion of the top surface of each of the belts 52,52 is provided so as to run at a position in the vicinity of the upper surface of the rear base plate 43. Further, the conveyor drive device 6 is designed so that, using a motor 61 which can rotate in the forward and reverse directions, it can rotate the roll 51 on one side (left side) of the conveyor 5 forward and reverse via a sprocket and chain.

When a rectangular cloth piece Y is pulled inside the frame, at the portion where the conveyor 5 is installed, a lateral edge detecting device 71 which uses a photoelectric tubes detects the lateral edge Yb at the edge forming side of the rectangular cloth piece. Further, this lateral edge detecting device 71 is provided so that the sensing portion thereof is directed upward in the interval of space S between the first belt 52 and the second belt 52, as seen from the front of the frame, of the conveyor 5 on the rear base plate 43, and approximately directly under the position where the holding means 22 for holding the corner of the cloth piece passes.

The final edge detecting device 72 employs a photo electric tube and detects the presence of the final edge Yc when the final edge Yc of the rectangular cloth piece Y is approaching the lateral edge of the front of the frame of the conveyor 5 on the bench 4. That is to say, the final edge detecting device 72 is provided near the edge of the conveyor 5, which is on the rear base plate 43, that is near the front of the frame, and so that the sensing portion of the final edge detecting device 72 is directed upward approximately directly under the position where the approximate center of the movable body along the right to left direction passes. Further, the lateral edge detecting device 71 and final edge detecting device 72 respectively transmit the detected or non-detected state of the cloth piece to the controller 10.

A controller 10 receives a signal from the lateral edge detecting device 71 and exercises control with respect to the conveyor drive device 6 such that the conveyor 5 is run in either the forward or reverse direction. At the same time, the controller 10 receives a signal from the final edge detecting device 72 and exercises control with respect to the movable body drive device such that operation thereof is halted. In other words, when the lateral edge detecting device 71 is in a cloth non-detection state (i.e., when there is no cloth piece directly above the lateral edge detection device 71), control is exercised with respect to the conveyor drive device 6 so that the upper surface of the conveyor 5 runs in the direction of the extrusion of the lateral edge (i.e., from left to right). When the lateral edge detecting device 71 is in a cloth detection state, control is exercised with respect to the conveyor drive device 6 so that the upper surface of the conveyor 5 runs in the pulling direction of the lateral edge (i.e., from right to left).

Accordingly, the lateral edge of the edge forming side of the portion of the rectangular cloth piece which is in contact with the top of the conveyor 5 is positionally adjusted little by little only within a small range to the right and left of the detection position of the lateral edge detecting device 71. Further, when a rectangular cloth piece Y is pulled inside the frame together with the movable body 2, the detection state of the final edge detecting device 72 first changes from a cloth non-detection state to a cloth detection state as the rectangular cloth piece Y approaches above the final edge detecting device. When the movable body 2 is transferred further back and thereby the final edge Yc of the rectangular cloth piece Y is moved to a position further within the frame than the sensing position of the final edge detecting device 72, then the final edge detecting device 72 again enters a cloth non-detection state. However, when a signal generated at this time is received from the final edge detecting device 72, then control is exercised by the controller 10 to immediately halt the operation of the movable body drive device 3.

When transferring a rectangular cloth piece Y onto a bench 4 while maintaining contact resistance at a convex shaped front edge portion 42, the lateral edge Yb of the rectangular cloth piece Y tends not to lie parallel to the direction of transfer and does not spread open. To address this problem, such a mechanism as the one disclosed in Japanese Patent Provisional Publication (Kokai) No. 4-9198, which aligns the lateral edge Yb of the cloth piece Y using a split feed belt conveyor 5, has been proposed as a method for correcting the lateral edge of the cloth piece so as to be parallel to the direction of transfer.

However, not only this conventional device is complicated and costly, but also it does not provide increased capabilities because, when the time required to correct the position of the lateral edge of the cloth piece Y is added to the time required for spreading the cloth piece Y, the time for each spreading cycle becomes lengthy. Further, because the correction of the position of the lateral edge Yb of the cloth piece is carried out after the cloth piece Y is transferred and placed on the feed belt 5, there is no tension in the cloth piece Y, and the cloth piece Y is transported to the next process with wrinkles remaining therein, so that the finished quality of a finished item, such as a sheet, at an ironer device in subsequent processes, is degraded.

Further, because the rectangular cloth piece Y is gripped by grippers 22, 23 at a corner $C_1$ and at a position on the side which includes this corner $C_1$, and is placed onto the bench 4, when handling a very long rectangular cloth piece, the corner opposite the gripped corner $C_1$ hangs down in a tail-like fashion and remains sticking out from the bench 4. At the next movement in the perpendicular direction, this corner can become caught or entangled in the machinery of the device. If, when moving the cloth piece with the grippers 22, 23, an attempt is made to pull the cloth piece up onto the bench 4 until the tail-like portion $C_3$ thereof is also on the bench 4, then a longer bench becomes necessary and the size of the machine equipment disadvantageously increases.

Furthermore, even when a failure (folding, wrinkling or diagonal feeding) occurs and a rectangular cloth piece Y which has been moved up onto the bench 4 is not spread properly, because the conventional apparatus has neither a detecting means nor an expulsion means, the rectangular cloth piece is relayed as it is to the next process. As a result, such accidents as cloth catching or blocking up occur in the subsequent processes of rolling, ironing, etc. Further, it becomes necessary to reprocess any of such cloth pieces which proceed all the way through to the final process (ironer), and this is disadvantageous in that it causes manpower and energy to be spent wastefully.

OBJECT AND SUMMARY OF THE INVENTION

The present invention is proposed in order to resolve the above described problems which are encountered in the prior art.

For this purpose, as a means to resolve the aforementioned problems, the present invention provides a cloth spreading apparatus provided with a suction duct having numerous suction holes disposed over approximately a half of the track surface for pulling the cloth piece on the bench, the half being a half on the side of the cloth piece edge, in which cloth spreading apparatus, after a rectangular cloth piece is suspended in a natural fashion by gripping it at any one corner of the cloth piece and at a position on the side of the cloth piece which includes the gripped corner with a movable gripper to which two clips are attached, the cloth piece is pulled by the gripper and moved horizontally to the upper surface of a bench which comprises a conveyor and the like, as the cloth piece receives contact resistance from a convex shaped front edge portion of the bench, and is pulled onto the bench.

Because while the rectangular cloth piece is pulled over the bench it is also pulled down by suction on the half of the track surface for pulling the cloth piece through the numerous holes formed on the bench, only the edge side of the cloth experiences frictional resistance in the pulling direction. Thus, it is possible to maintain parallel lines of the cloth with respect to the direction of pulling. Further, because it is possible to place the above-mentioned edge of the cloth piece on the bench as some tension is maintained from the edge portion held by the gripper to the end portion of the cloth piece, when sending the cloth in this state to the next process of ironing, it is possible to obtain a good finished quality for a sheet or the like.

Further, as a means for resolving the aforementioned problems, the apparatus of the present invention may be equipped with: a detection sensor positioned above and in the vicinity of the cloth intake opening of the bench for detecting the end edge of the cloth piece when an end edge portion of the cloth piece is passing through the intake opening; and a control device which receives a signal from the aforementioned sensor, calculates the timing of the centering of the edge of the cloth piece from the speed of advance of the gripper and from the timing of the passage of the gripper and the passage of the end edge of the cloth piece, and operates a grip release mechanism in the clips of the gripper.

The timing at a passage position of the cloth piece is detected by a sensor as the cloth piece moves on the bench, the timing of centering is calculated and the cloth piece is released from the grip, therefore no time loss occurs in this process.

Furthermore, as a means to resolve the aforementioned problems, the present invention may provide a spreading apparatus which further comprises a roller which pushes the spreading side of the cloth piece placed at the end of the conveyor which forms the bench and which runs in a direction horizontal and perpendicular to the direction in which the cloth is pulled; a horizontal slit equipped with a downward-directed convex shaped spread plate which slit pulls by air suction a center portion of the cloth piece which is hanging down from an end of the conveyor in the bench after the spreading side edge of the cloth is held between the end of the conveyor and the aforementioned roller and which is transferred in a direction opposite to the spreading side of the cloth piece; a push bar which pushes the upper portion of the cloth piece which is hanging down onto a spread relay conveyor provided underneath the bench; and a friction roller provided at a front portion of the spread relay conveyor.

Further, as a means to resolve the aforementioned problems, the apparatus of the present invention may be further equipped with: a concave shaped front edge portion which is continuous with a convex shaped front portion of a cloth piece intake on the bench; a nozzle chamber attached to the frame of the spreading apparatus along the center line of the concave shaped front edge portion, wherein an upper surface of said nozzle chamber is in the same plane as an upper surface of the bench and which has a plurality of nozzle holes for blowing out air in an inclined upward direction within the direction of transfer of the cloth piece on said upper surface of said nozzle chamber; an air source for sending air to the nozzle chamber; and a guide plate for guiding a tail-like corner end of the cloth piece blown up by air coming out from the nozzle holes to a specified position on the bench.

Furthermore, because when the rectangular cloth piece is pulled onto the bench, the cloth piece which passes near the concave shaped front edge portion is separated therefrom, and is pushed up by the air blown out from the plurality of nozzles which are upstream from the front edge portion, the frictional resistance of the cloth piece in the vicinity of the front edge portion decreases. Further, when the transfer of the rectangular cloth piece is completed, because the surface area of the corner end of the cloth piece, which has been gathered together in the concave shaped front edge portion and hangs down tail-like, is small and this corner end of the cloth piece is light, this corner end can be blown up by the air blown out from the nozzle holes, guided by the guide plate and placed in a specified position on the bench. Accordingly, such troubles as the corner end of the cloth piece becoming caught or entangled and hindering the next process can be avoided.

Furthermore, as a means to resolve the aforementioned problems, the present invention is equipped with: at least two or more photoelectric sensors which are disposed in a straight line above the conveyor which runs in the horizontal plane perpendicular to the direction in which the cloth is pulled and which detect the passage of the cloth piece; a counter or timer which is disposed at the rotating portion of the conveyor drive portion and which generates a pulse for detecting the transfer distance of the conveyor; a calculating means which calculates a plurality of specified positions of the rectangular cloth piece on the conveyor by inputting the signal from the plurality of photoelectric sensors to the counter or timer, and detecting the state of diagonal inclination of the rectangular cloth piece; and a control device which expels the cloth piece from the spreading apparatus by driving the conveyor for a longer period of time than the prespecified time in the case where the rectangular cloth piece exceeds permissible limits and has become diagonal.

When a cloth piece is moving on moving conveyor of the bench as the conveyor moves, the plurality of photoelectric sensors placed in a line above the conveyor detect the final edge portion of the rectangular cloth piece. If the final edge portion of the rectangular cloth piece is diagonal or inclined with respect to a line perpendicular to the advancing direction of the conveyor, some difference is found in the detection timing of each photoelectric sensor. The detection signals of the respective photoelectric sensors are input to the counter or timer and calculations are carried out. If differences in timing are within permissible limits, then the rectangular cloth piece is sent to the next process, and if such timing differences exceed those permissible limits, then the rectangular cloth piece is expelled from the spreading apparatus and out of subsequent processing.

Furthermore, as a means to resolve the aforementioned problems, the present invention comprises at least two or more photoelectric sensors disposed below the push roller and in a line parallel to the push roller for detecting the rectangular cloth piece when the rectangular cloth piece is held between the push roller and the conveyor which runs in a direction horizontal and perpendicular to the direction in which the cloth piece is pulled, and the conveyor is stopped and the rectangular cloth piece hangs down; and a control device which sends the rectangular cloth piece out to the next process after the presence of the rectangular cloth piece has been confirmed by the photoelectric sensors, and which, when the presence of the cloth piece is not detected, drives the conveyor to expel the rectangular cloth piece from the line.

A rectangular cloth piece moves on the conveyor of the bench, and then stops to hang down with the final edge portion thereof held stationary between the push roller and the conveyor at the end portion of the conveyor. Then the presence of the hanging down portion of the rectangular cloth piece is confirmed by the plurality of photoelectric sensors disposed under the push roller, and the cloth piece is relayed to the next process. If the photoelectric sensors do not detect the presence of the rectangular cloth piece, a judgement is made that such accidents as the rectangular cloth piece becoming folded or separated from the push roller occurred, and the mechanism which expels the cloth piece from the processing line is put into operation.

DETAILED DESCRIPTION OF THE PREFERRED EMBODIMENTS

Figure 1:
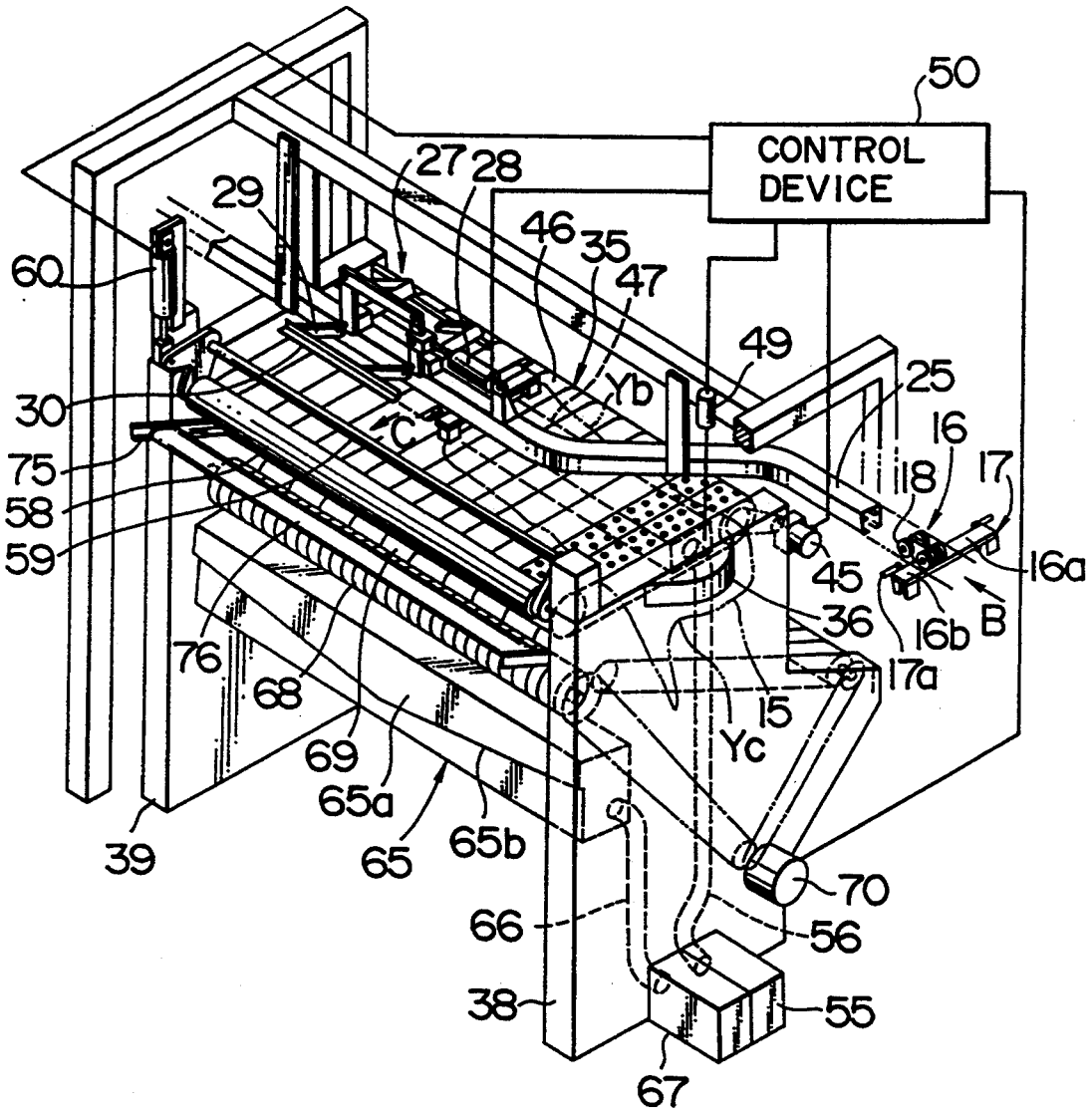
FIG. 1 is a perspective view of the spreading apparatus for rectangular cloth pieces according to the embodiments of the present invention, and shows the principal structural components thereof.
Figure 17:
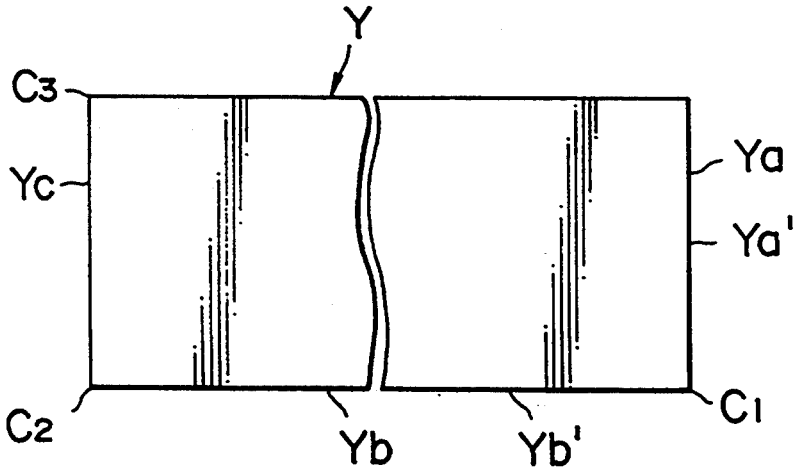
FIG. 17 is an explanatory diagram showing the reference symbols for each of the portions of the rectangular cloth piece.

The present invention will be explained below using the preferred embodiments shown in the accompanying drawings. FIGS. 1 through 11 show the preferred embodiments of the present invention. FIG. 1 is a perspective view showing the sheet spreading apparatus in totality. Additionally, it is noted here that the reference symbols assigned to each corner and edge of the sheet 15 are shown in FIG. 17, and the same reference symbols will be used throughout the body of this explanation.

In the drawings, any one corner $C_1$ of a sheet 15 and an edge Ya which includes this corner $C_1$ are brought by human hands to two clips 17 attached to the gripper or grip means 16 and spaced a shoulder width distance apart from each other and held there by clipping. The gripper 16 runs within a guide rail 25 by means of four gear wheels 18, while at the same time, a chain 26 is interlocked with a latch provided in the upper portion of the gripper. The gripper 16 is designed so that it can be driven, via the chain 26, by the chain drive means, not shown in the figures. Further, the gripper 16 can be freed from its interlock with the chain 26 and freely run on the inclined guide rail. As for the arms of the gripper 16 which support clips 17, the arm **16*a*, which is on the side of the gripper 16 which grips the corner $C_1$, is long, while the arm 16*b*, which is on the side of the gripper 16 which grips the edge Ya, is short. This is because a comparison of the application of the weight load on the two clips 17 when the sheet 15 which is held by the gripper 16 hangs down naturally, reveals that the weight load on the arm 16*b*** side can be quite large.

The gripper 16 which suspends the sheet 15 is driven by the chain 26 and in this manner moves on the guide rail 25 in the loading direction of the arrow B shown in FIG. 1 toward the spreading apparatus. The sheet 15 is pulled onto an upper or sheet surface of the bench 35 as it is spread open by the convex shaped front edge portion 36. Further, the gripper 16 proceeds along the guide rail 25 and, at a position where the placement of the lateral edge Yb of the sheet 15 on the bench 35 is completed, the sheet 15 is released by a clip grip release mechanism 27. In other words, in the clip grip release mechanism 27, a pressurized actuator 28 operates, and a lever 29 rotates and a push plate 30 pushes the release arm **17*a* of the clip 17, releasing the sheet 15** as stated above.

Figure 2:
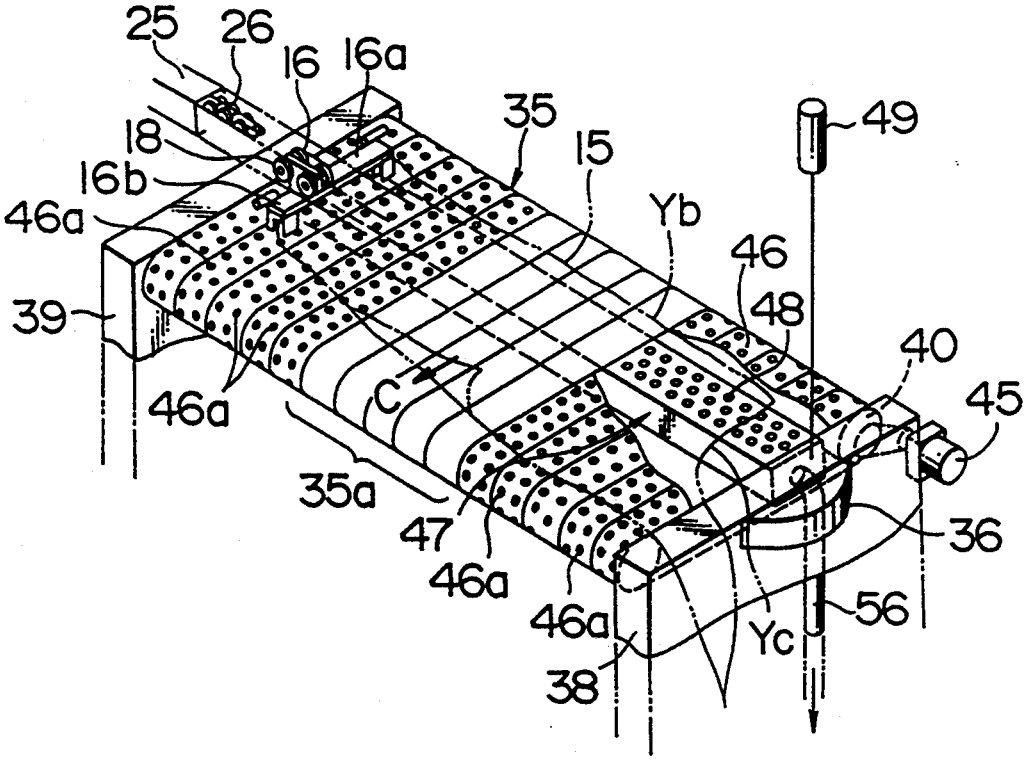
FIG. 2 is a perspective view of the cloth piece bench in FIG. 1.

FIG. 2 is a perspective view showing the structure of the bench 35. The bench 35 includes a conveyor means which comprises a plurality of the flat belts 46 suspended by pulleys 40 and moves the sheet 15 in an unloading direction C. Pulleys 40 are driven intermittently by a motor 45 supported by the frame 38, 39 which are on each side of the structure. Numerous small holes **46*a* are formed over the entire surface of flat belts 46. A net belt of a rough mesh material through which air easily passes may also be employed as the flat belts 46. Belts which do not have any holes formed therein may be employed at the center portion 35*a* of the bench 35**.

Furthermore, a resistance means for applying resistance to the sheet includes suction duct 47 which is in contact with the inner surface of the flat belts 46 is provided extending across approximately the entire width of the bench 35. Numerous small holes 48 are formed in the upper or sheet surface of the duct 47, namely, in the surface which is in contact with the flat belts 46. These small holes 48 may be omitted from the center portion of the suction duct 47 to correspond to the belts 46 as described above in which no holes have been formed. Photoelectric sensors 49 are attached above the frame 38, and are for detecting the passage of the gripper 16 and the passage of the final edge Yc of the sheet 15. The signal from this sensor 49 is sent to the control device 50, and calculation processing is carried out.

Figure 3:
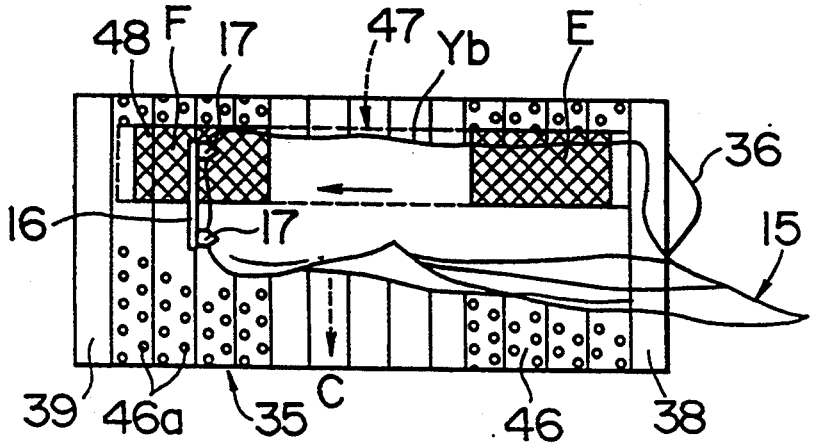
FIG. 3 is a plan view of the cloth piece bench in FIG. 2.
Figure 4:
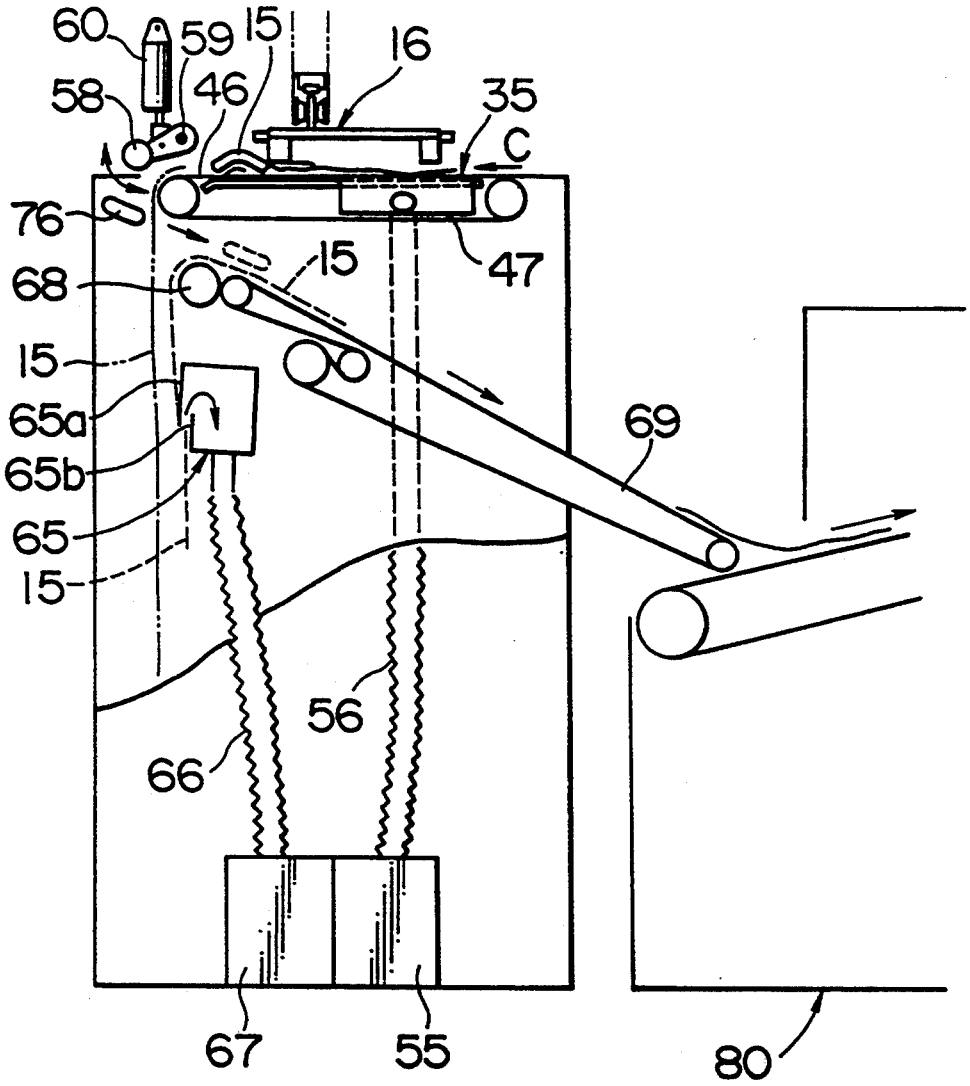
FIG. 4 is a cross sectional side view of the spreading apparatus for rectangular cloth pieces in FIG. 1.

FIG. 3 is a plan view of the bench 35, and shows the relative position between the position of the sheet 15 which has been pulled and placed on the bench 35, and the position of the group of suction holes 48 of the suction duct 47. As in this figure, the range within which the suction action of the suction duct 47 acts is in the area of the lateral edge Yb side of the sheet 15 (i.e., the portion held by the clippers 17,17), this being approximately half of the surface path of the sheet 15 being pulled. In other words, the range within which the suction of the suction duct 47 acts is the are sheet dye portions which are separated to the front and rear of the advancing direction of the sheet 15. These portions are indicated by the symbols E and F in the figure. Additionally, while the range within which the suction acts may be extended over the entire length of the path surface, in this case, the suction resistance may become excessive. Additionally, as shown in FIG. 4, the suction duct 47 is connected to a suction blower 55 by a pipe 56.

Figure 5:
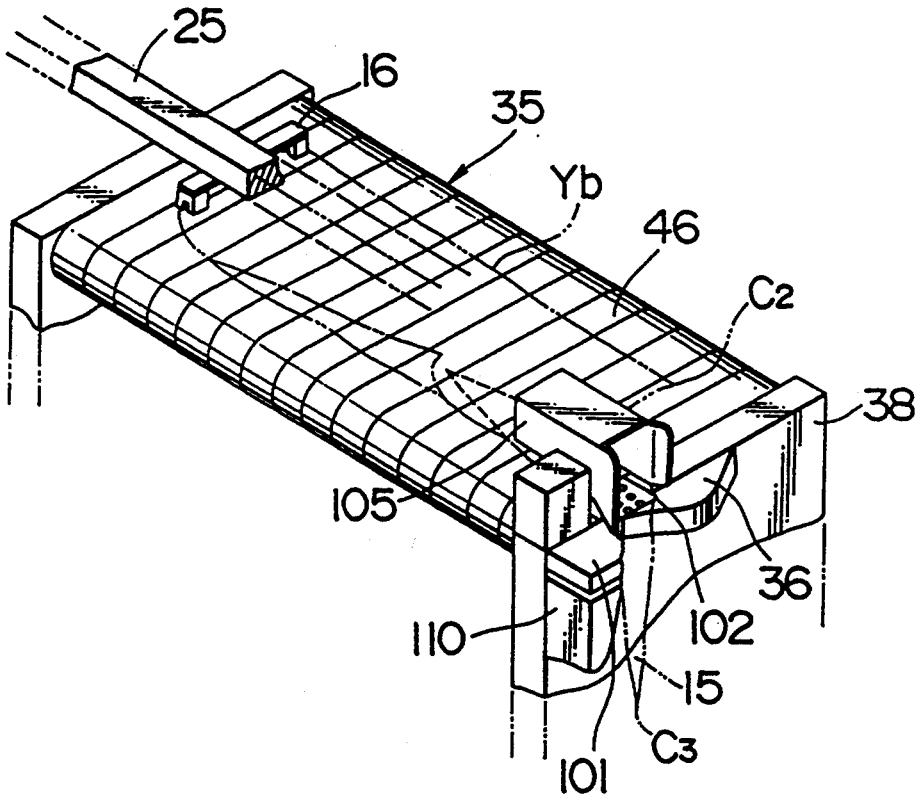
FIG. 5 is a perspective view of the nozzle mechanism for blowing up the corner of the cloth piece according to the embodiments of the present invention.

Next, the structure of the sheet blowing nozzle mechanism will be explained using FIGS. 5 and 6.

A concave shaped front edge portion 101 is attached to the frame 38 and is continuous with the convex shaped front edge portion 36 of the cloth intake portion of the bench 35. A nozzle chamber 102 which is aligned along the center line of the concave shaped front edge part 101 is attached to the upper portion of the frame 38. The upper surface of the nozzle chamber 102 is aligned in the same plane as the upper surface of the bench 35. A plurality of nozzle holes 103 are formed in the upper surface of nozzle chamber 102 for blowing out air diagonally in the direction of movement of the sheet 15. Air is relayed to the nozzle 102 from an air source, not shown in the figures, via an air relay pipe 104.

Further, a guide plate 105 is provided for guiding so that the corner $C_3$, which hangs down tail-like, of the sheet 15 which has been blown up by the air blown out from a nozzle hole 103 can be turned over with reliability and placed at a prespecified position on the bench 35. Additionally, if a guide box 110 is provided below the concave shaped front edge portion 101, when transferring the tail-like portion of a sheet 15 which has long length dimensions, it is possible to control the movement thereby with a result that stability is increased.

FIG. 4 is a side cross-sectional diagram of the spreading apparatus. Using FIGS. 1 and 4, the structure of the mechanism for spreading the entire surface of the sheet 15 will now be explained. A roller 58 is provided to the exit portion of the conveyor formed from the flat belts 46 on the bench 35. Roller 58 is rotated about an axis 59 at its center of rotation by the operation of a pressurized actuator 60, and can apply or release pushing pressure on the flat belts 46.

Furthermore, a vacuum air spreader 65 is attached to the frames 38, 39. At the front edge of the air spreader 65 there is provided a convex shaped spread plate **65*a* which is directed downward. The air spreader 65 draws by suction the sheet 15 by means of a downward directed suction slit 65*b* and is designed so as to fully utilize the convex shaped spread plate 65*a*. The air spreader 65 is also connected to a suction blower 67 via a pipe 66**.

A friction roller 68 driven by a motor 70, and a relay conveyor 69 for relaying sheet 15 which conveyor runs in an inclined downward direction are provided underneath the bench 35. Furthermore, numeral 76 indicates a push bar which is guided by the guides 75 attached to the frame 38, 39. By means of the intermittent driving of a chain (not shown) and a link mechanism (also not shown) which connects the push bar 76 with a position on the chain, this push bar 76 is guided in the guide 75 and moved in a reciprocating manner.

Next, the effects of the embodiments having the structure as described above will be explained. A corner $C_1$ of the sheet 15 and an edge portion Ya are gripped by the clips 17 of the gripper 16, and are pulled onto the bench 35, while receiving some contact resistance from the convex shaped front portion 36. At this time, if there is no suction force applied from the duct 47, then the lateral edge Yb of the sheet 15 is pushed by the other portions of the sheet 15 and the sheet 15 does not spread open entirely.

However, because of the provision of a suction duct 47, such as that of the present invention, the lateral edge Yb of the sheet 15 is suction pulled at the portion indicated by the symbol E in FIG. 3, and the friction resistance of that portion increases. As a result, the pulling force of lateral edge Yb of the sheet 15 increases, and the other portions of the sheet 15 are forced back. Thus, it is possible to pull by suction the lateral edge Yb straight and with some continuously maintained tension. The suction portion, indicated by the symbol F, of the bench 35 is effective in maintaining the lateral edge Yb under some tension when the sheet 15 is released from the clips 17 of the gripper 16 and placed on the bench 35. If a suction portion F is not provided, then, when the lateral edge Yb of the sheet 15 is released from the clips 17, the lateral edge Yb crumples, and wrinkles form easily.

When the sheet 15 is gripped by the clips 17 of the gripper 16 and advanced to the bench 35, photoelectric sensors 49 detect the gripper 16 and the final edge Yc of the sheet 15, and send a signal to the control device 50. In this control device 50, the timing of the centering of the sheet 15 with respect to the bench 35 is calculated from the timing of the passage of the gripper 16, the timing of the passage of the final edge Yc of the sheet 15, and the moving speed of the gripper 16. Then, the pressurized actuator 28 is operated, operating the clip grip release mechanism 27, to release the sheet 15.

Furthermore, when the sheet 15 is wet and has a large rectangular shape, it carries a large mass. When such a sheet 15 is pulled onto the bench 35, the movement of a portion of the sheet 15 is delayed and, even when the transfer operation is completed, a portion of the sheet 15 remains hanging down in a tail-like manner, gathered together in the concave shaped front edge portion 101. However, because the sheet 15 is gathered together when the sheet 15 passes through the concave shaped front edge portion 101, and is pushed up by the air blown out from the nozzle hole 103, the friction resistance of the sheet 15 in this vicinity against pull is reduced.

Figure 6:
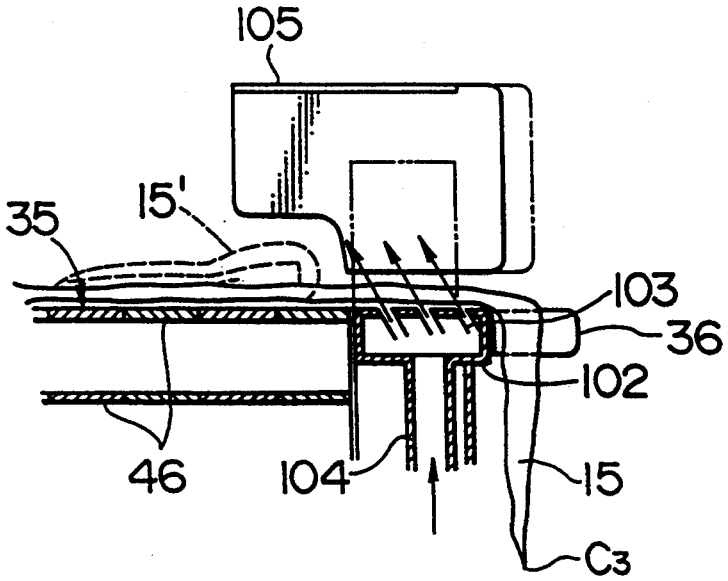
FIG. 6 is a front cross-sectional view of the nozzle mechanism in FIG. 5.
Figure 7:
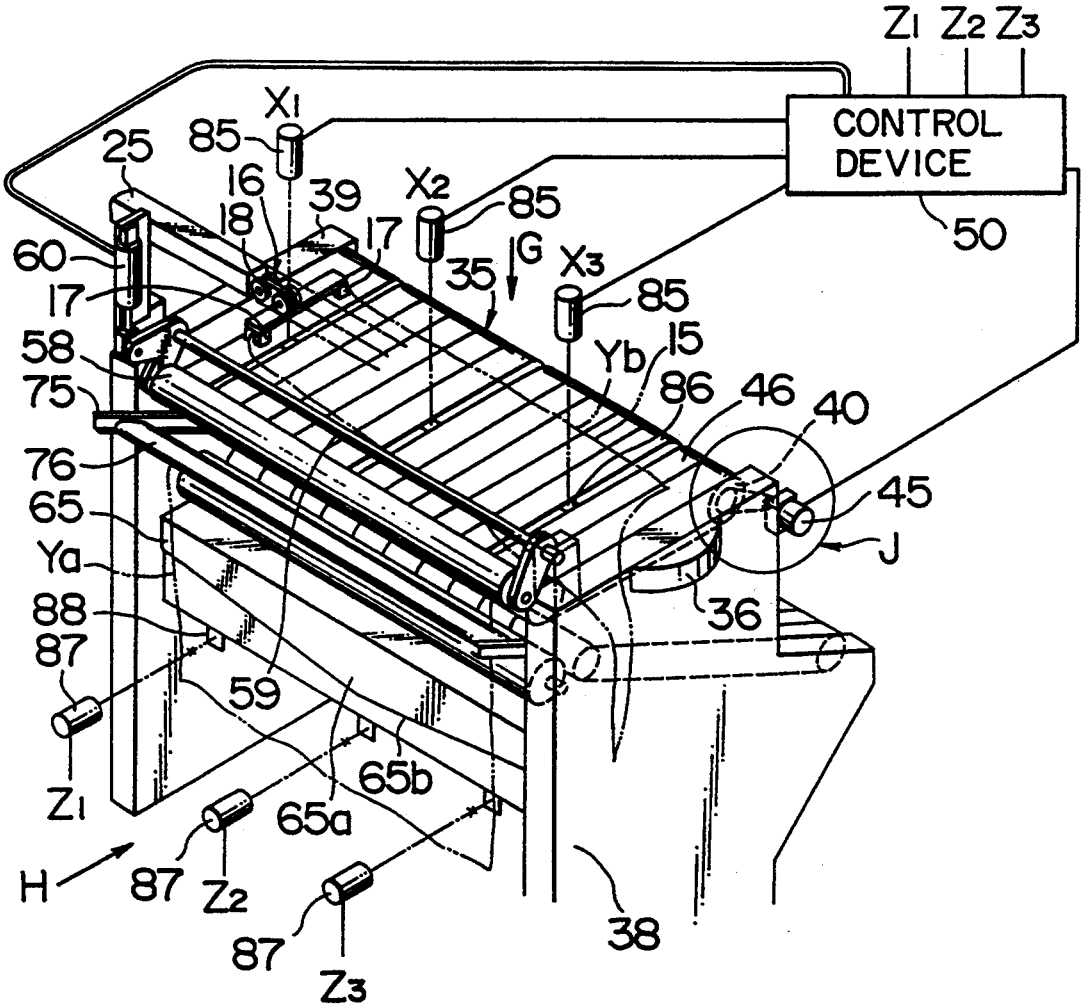
FIG. 7 is a perspective view of the sheet spreading apparatus according to the embodiments of the present invention, and shows in the main the cloth detection mechanism.

Because the remaining corner portion of the sheet 15 has a small surface area and is light, it can be blown up by the air blown out from the nozzle hole 103 in the direction shown by the arrows in FIG. 6. At the same time, this remaining corner of the sheet 15 is guided by the guide plate 105, and turns over as illustrated by the sheet 15' which is shown by the broken line in FIG. 6, and, thus, can be placed at a prespecified position on the bench 35. Accordingly, such troubles as the corner portion of the sheet 15 becoming caught on or entangled in the frame or the guide rail of the gripper 16 and thereby hindering the relay process of the sheet 15, are eliminated.

Furthermore, the sheet 15 which has been placed on the bench 35 is moved on the flat belts 46, which are driven by the motor 45, in the direction indicated by the arrow C in FIG. 4, and come to a stop at a location where the lateral edge Yb has reached a position in front of the roller 58. The other portions of the sheet 15 hang freely down from the end of the flat belts 46 (the position of the sheet 15 shown by the two-dot chain line in FIG. 4).

Next, the push bar 76 operates and the sheet 15 and the friction roller 68 are pushed up onto the relay conveyor 69 (the position of the sheet 15 shown by the broken line in FIG. 4), and the sheet 15 is relayed to the ironer 80 of the next process, while undergoing tension spreading by the air spreader 65 and the friction roller 68.

Additionally, it is noted here that in the embodiments of the present invention an explanation was made for the spreading of a rectangular shaped cloth, however, the present invention can also be applied to a square shaped cloth without any difficulty. Further, in the embodiments of the present invention, an explanation was made using an example where any one corner $C_1$ of the sheet 15 and the lateral edge Ya which includes this $C_1$ are gripped, however, the present invention can be applied in the same manner even if one portion of the lateral edge Yb of the long side of the cloth piece (for example, $C_1$ and Yb' portions shown in FIG. 17) is held. In this case, the edge portion of the short side of the sheet 15 becomes the portion which undergoes edge setting (the edge portion indicated by Ya in FIG. 17).

Figure 8:
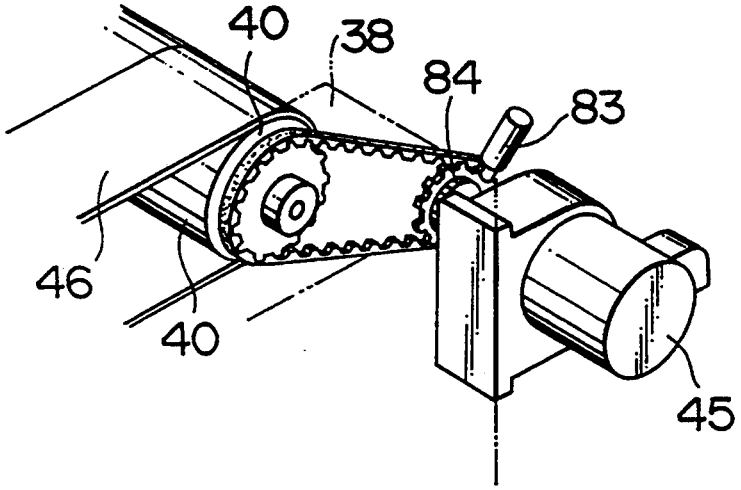
FIG. 8 is an enlarged view of the portion J indicated in FIG. 7.
Figure 9:
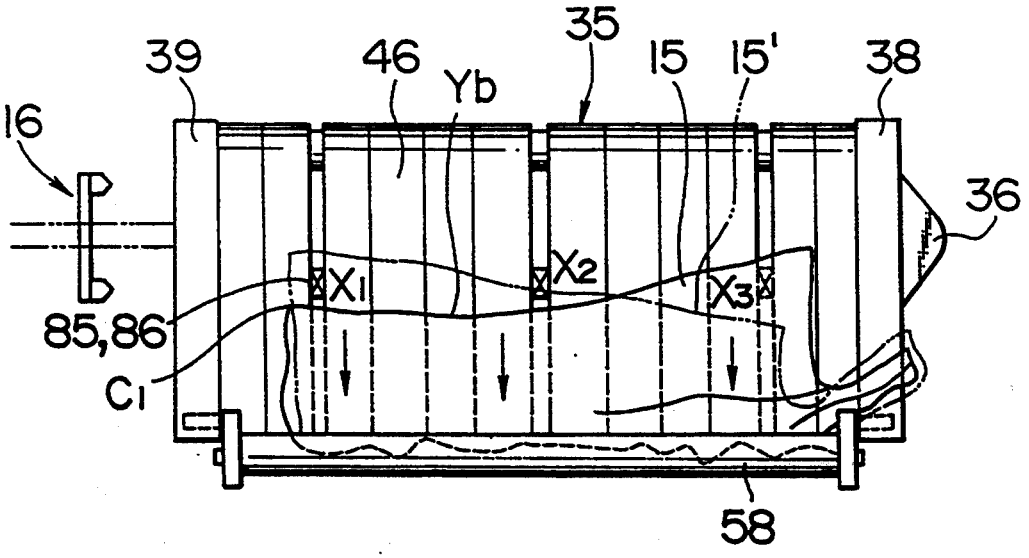
FIG. 9 is a view along the arrow G shown in FIG. 7.

Next, an explanation of the sheet spread detection mechanism will be made using FIGS. 7 through 11. Photoelectric sensors 85 (indicated by $x_1$, $x_2$ and $x_3$ in FIGS. 7 and 9), wherein there are three photo beam light sources for detecting the passage of the sheet 15, are disposed above the conveyor 46, which runs in the horizontal plane perpendicular to the direction of pulling of the sheet 15, in line with the direction of pulling. Reflection plates 86 are placed at positions where the light beams from these photoelectric sensors 85 hit; i.e, the reflection plates 86 are disposed in spaces between the conveyor 46. A gear wheel 84, shown in FIG. 8, is attached to the output axis of a low speed motor 45 for driving the conveyor. A proximity sensor 83 is disposed near the gear wheel 84. The proximity sensor 83 senses the cogs of the gear wheel 84, and generates a pulse for counting, and the transfer distance of the conveyor is changed according to this pulse number.

Furthermore, provided that the speed of the conveyor 46 is constant, a timer may be employed in place of a pulse counter of this type. The sheet 15's final edge Yb, which has been referred to as the lateral edge Yb when discussions were made above concerning how the sheet 15 is drawn into the spreader apparatus, passes through the positions $x_1$, $x_2$ and $x_3$ at which the light beams of the plurality of photoelectric sensors 85 are disposed, and a signal generated as a result of this passage is input to the time signal of the aforementioned counter or timer. The diagonal state of the final edge Yb of the sheet 15 is changed by the pulse or the time difference. The running of the conveyor 46, the counter pulse, and the timing wherein the photo beam of the photoelectric sensor 85 is ON at the final edge Yb of the sheet 15, are shown in the timing chart in FIG. 11.

When the sheet 15 is separated from the clips 17, namely, slightly after a command signal for clip grip release is output, the conveyor 46 begins moving. After the conveyor 46 runs a distance, as set by the timer or counter, from this starting position, the final edge Yb of the sheet 15 is held between the conveyor 46 and the push roller 58, and is halted in a state wherein the sheet 15 is hanging down. When, from the calculation results, it is revealed that the sheet 15 is in a diagonal state which exceeds permissible limits, the setting of the counter or timer is changed so as to lengthen the running time of the conveyor 46, and, thus, control is exercised so that the sheet 15 is expelled, without stopping, from the line.

Moreover, the present invention has a mechanism for inspecting and confirming the normality or anomaly of the sheet 15 at the position wherein the sheet 15 is held between the conveyor 46 and the push roller 58 and hangs down when the conveyor 46 is stopped. This confirmation inspection mechanism will be explained using FIGS. 7 and 10. Three photoelectric sensors 87, wherein there are established photo beam photo source, are disposed below the push roller 58 in a straight line in the horizontal plane, and are for the detection of the sheet 15. (The positions of disposition of the photoelectric sensors 87 are indicated by the symbols $z_1$, $z_2$, and $z_3$ in FIGS. 7 and 10.) A reflection plate 88 is attached at the positions where the photo beams of the photoelectric sensors 87 hit. A signal confirming the presence of the sheet 15 is sent to the control device 50 by the photoelectric sensors 87, and the control device 50 actuates the operation circuit for the means for relaying the sheet 15 to the next process. If any one of the photoelectric sensors 87 does not detect the presence of the sheet 15 at this time, the control device 50 which receives this signal orders the expulsion of the sheet 15 from the line.

Figure 11:
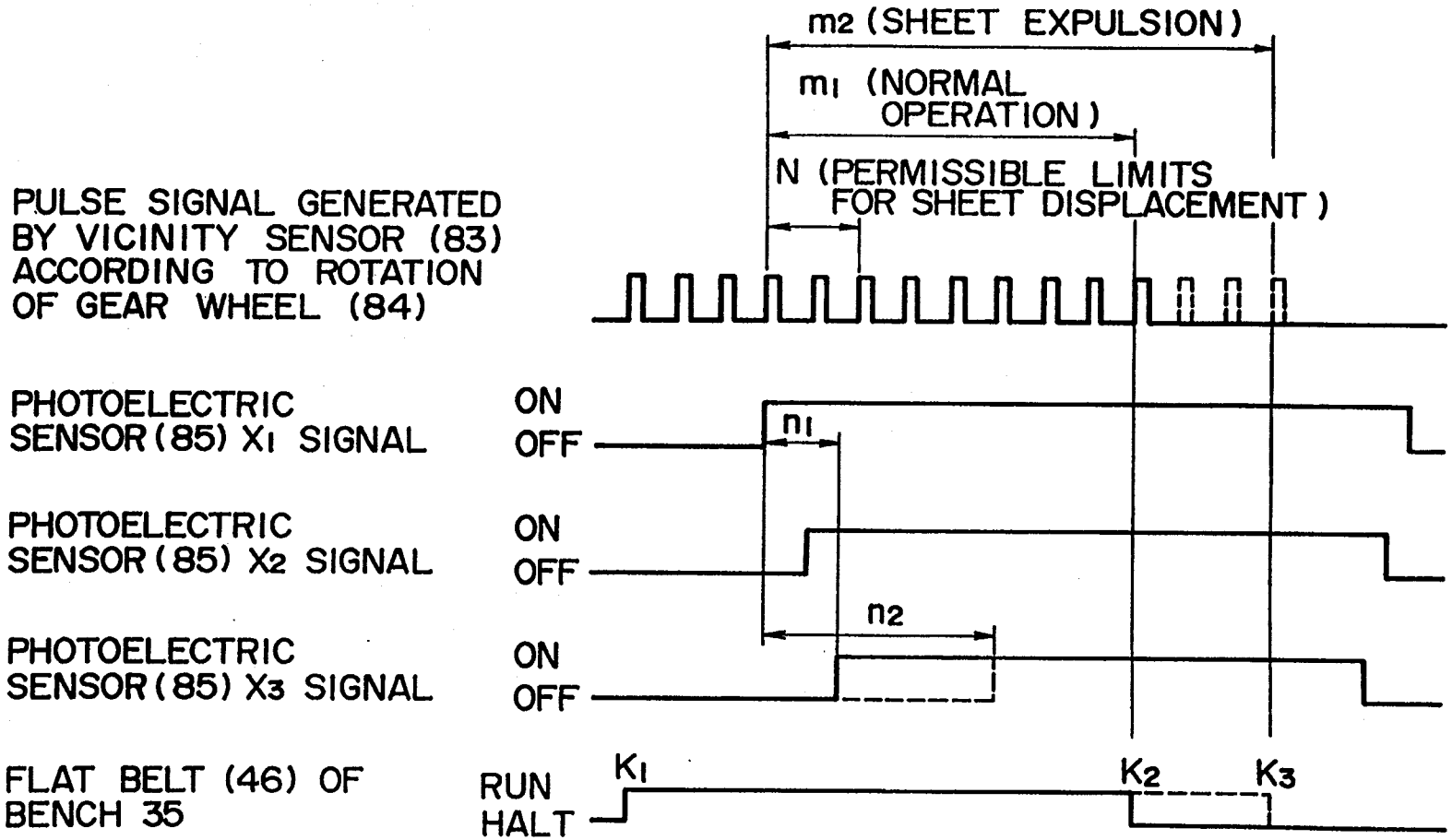
FIG. 11 is an explanatory diagram which illustrates an embodiment of the present invention and shows the timing of the operation of the sheet spreading apparatus
Figure 12:
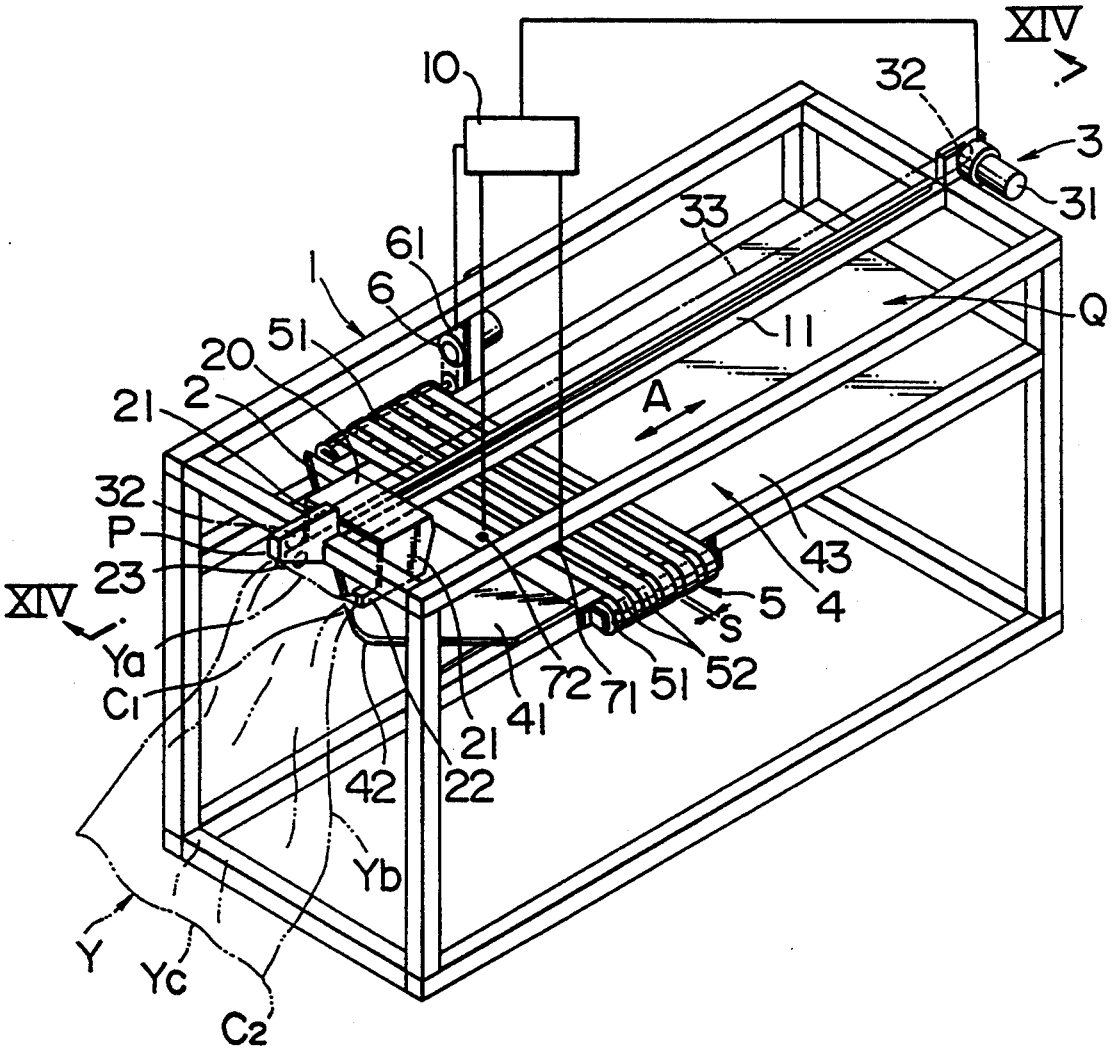
FIG. 12 PRIOR ART
FIG. 12 is a perspective view of a rectangular cloth spreading apparatus of the prior art.
Figure 13:
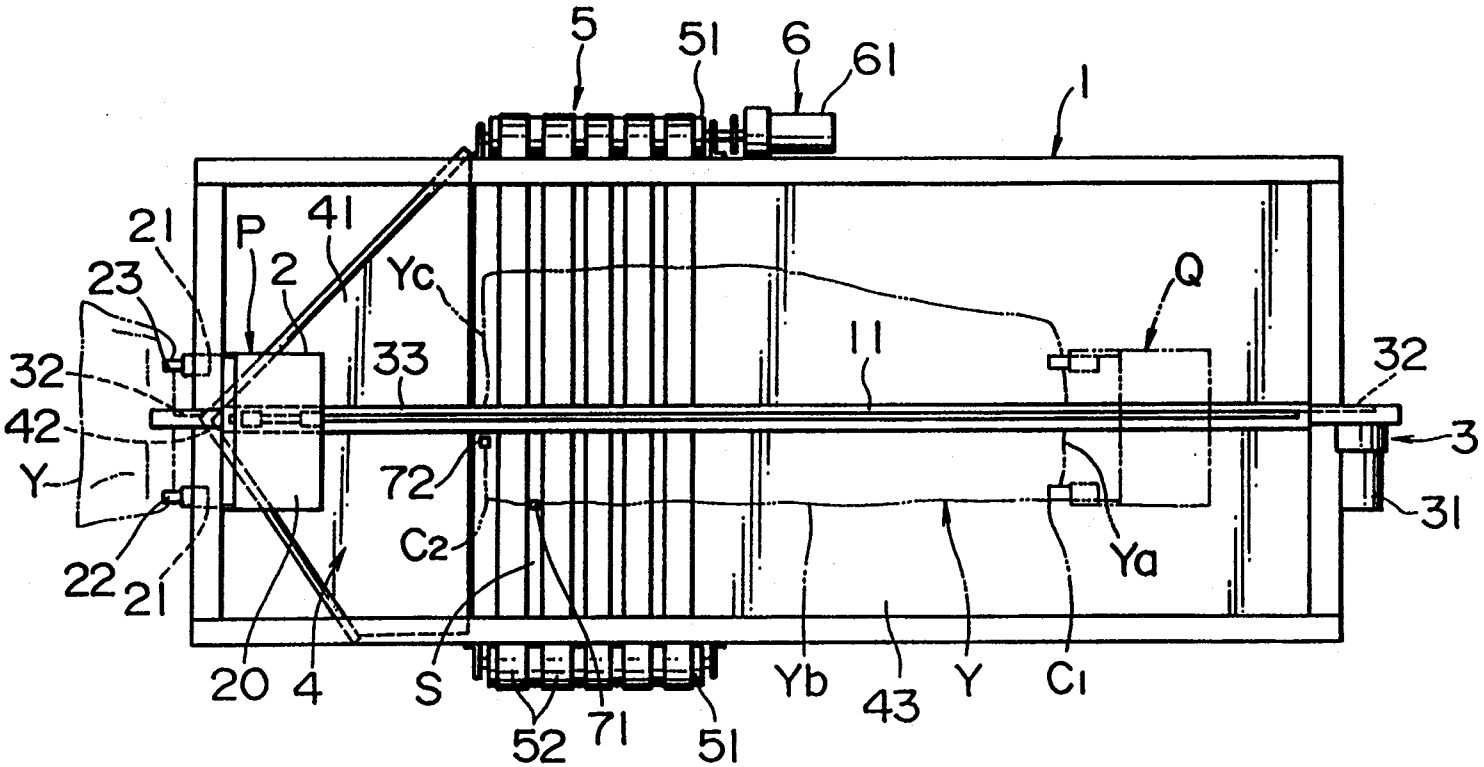
FIG. 13 PRIOR ART
FIG. 13 is a plan view of FIG. 12.
Figure 14:
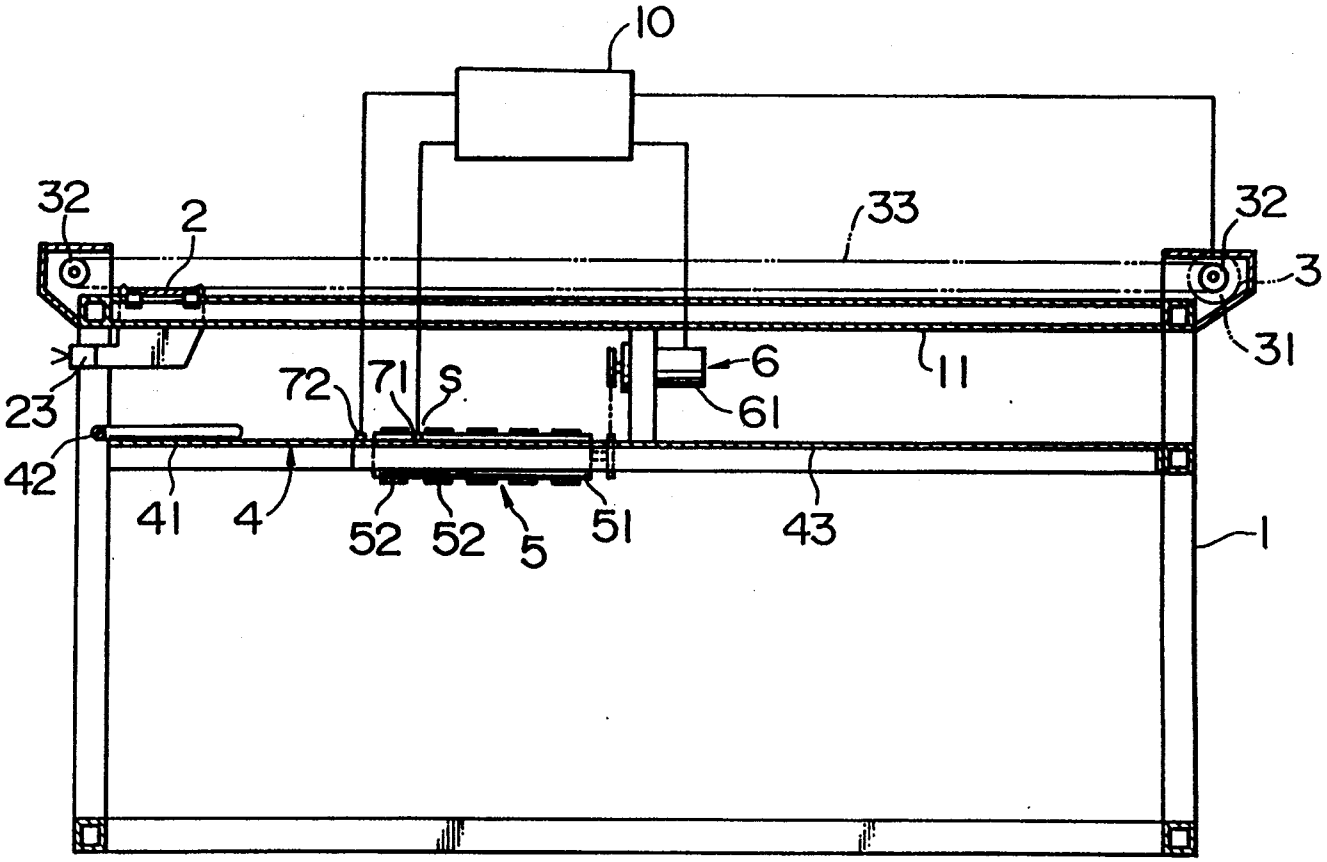
FIG. 14 PRIOR ART
FIG. 14 is a cross-sectional view along the line XIV—XIV shown in FIG. 12.
Figure 15:
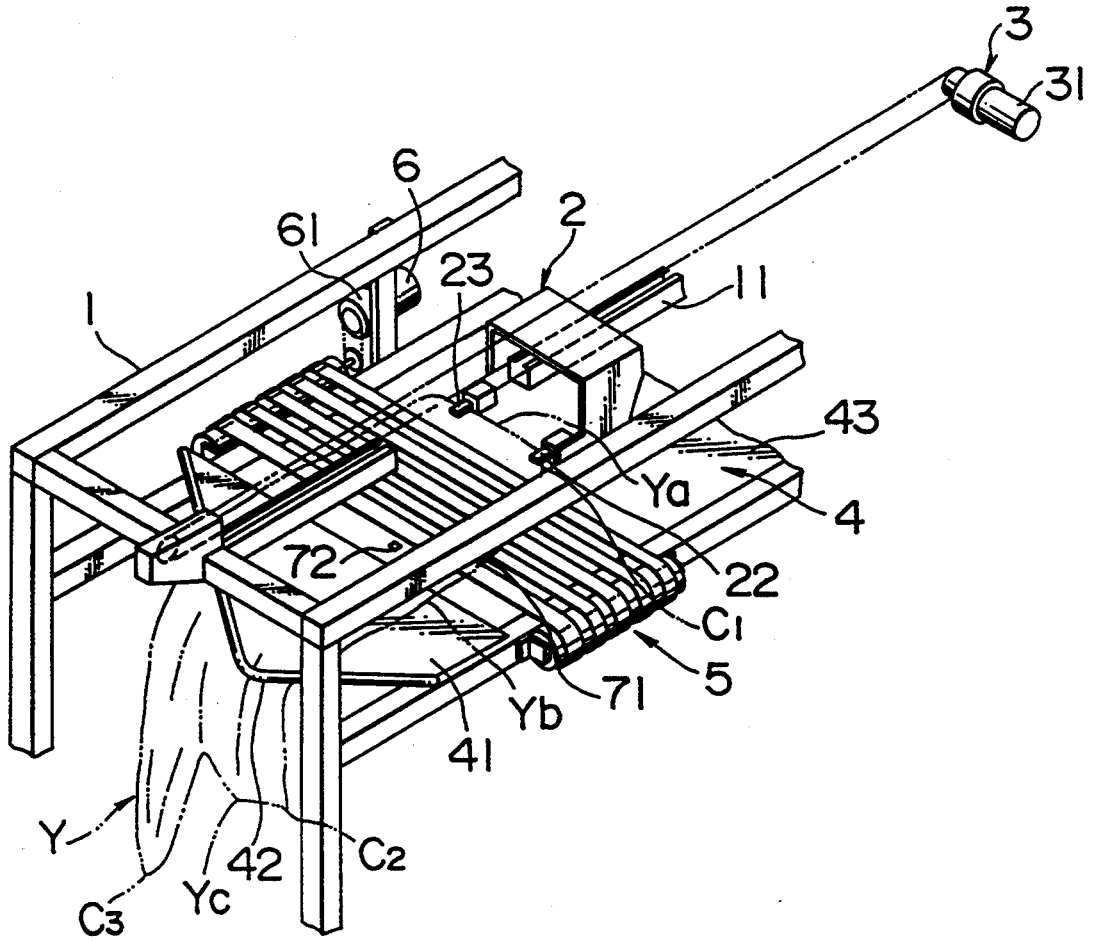
FIG. 15 PRIOR ART
FIG. 15 is a perspective view of a different operating state of the same apparatus as shown in FIG. 12.
Figure 16:
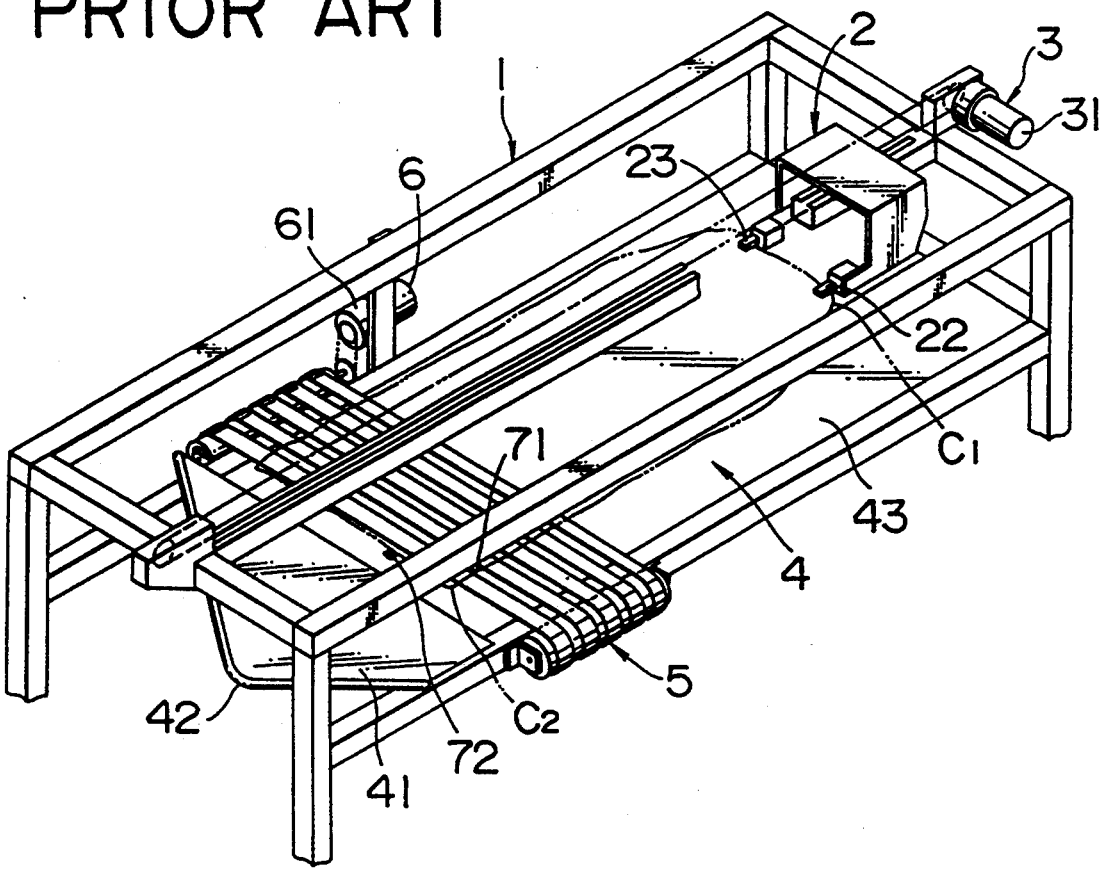
FIG. 16 PRIOR ART
FIG. 16 is a perspective view of yet another different operating state of the apparatus shown in FIG. 15.

Next, an explanation of the effects of the embodiments constructed as described above will be made. When the sheet 15 is placed on the conveyor 46 of the bench and the conveyor 46 is moved, the plurality of photoelectric sensors 85 placed in a straight line detect the final edge Yb of the sheet 15. If the final edge Yb of the sheet is displaced diagonally from the line perpendicular to the direction of advance of the conveyor 46, like the sheets 15,15' shown respectively by the solid line and two-dot chain line in FIG. 9, then, as shown in FIG. 11, a difference is generated in the timings detected by each of the photoelectric sensors.

The difference in the detected timing (i.e., the degree of diagonal shift of the final edge Yb of the sheet 15) is substituted with the counter pulse or timer and calculations are carried out. If the timing difference is within the permissible limits for the value N, such as $n_1$ shown in FIG. 11, the conveyor 46, which started moving at position $k_1$, runs from a reference position at which the position $x_1$ of the photoelectric sensor beam is ON, for a counter pulse of $m_1$ only, this corresponding to the normal operating distance and, at a position $k_2$, the conveyor 46 comes to a halt. If the timing difference exceeds permissible limits for the value of N, such as $n_2$, the counter pulse is automatically set to $m_2$, which increases the operation distance to be greater than the normal operation distance, and the conveyor 46, which started moving at $k_1$, runs from a position wherein the position $x_1$ of the photoelectric sensor beam is ON, for a distance corresponding to the counter pulse $m_2$, and comes to a halt at a position $k_1$ after expelling the sheet from the line. Then, the next sheet 15 is carried by the gripper 16, being pulled horizontally and placed on the conveyor 46 of the bench 35.

When a sheet 15 is relayed by the conveyor 46, and hangs down with the final edge Yb of the sheet 15 being held stationary between the conveyor 46 and the push roller 58 at the end of the conveyor 46, the confirmation of the presence of the hanging down portion of the sheet 15 is performed by the three photoelectric sensors 87, and a signal is transmitted to the control device 50. The control device 50 actuates the operation circuit for push bar 76 which sends the sheet 15 to the next process.

Figure 10:
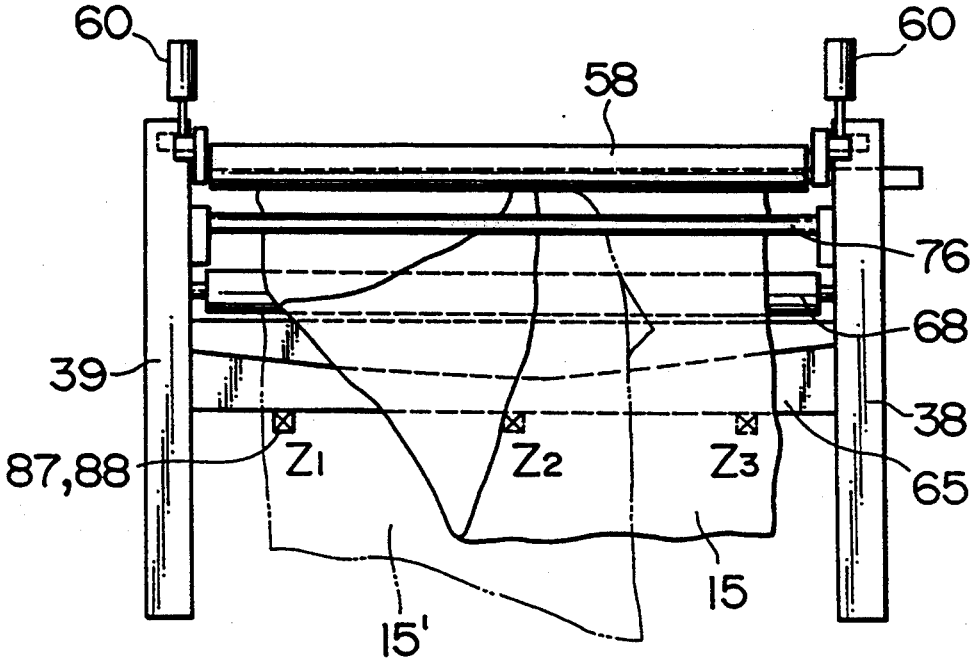
FIG. 10 is a view along the arrow H shown in FIG. 7.

When there occurs such troubles as the sheet 15 becoming folded like the sheet 15 shown by the solid line in FIG. 10, or the sheet 15 coming free from the push roller 58 midway through the push rolling by the push roller 58, like the sheet 15' indicated by the two-dot chain line in the same figure, and one of the photoelectric sensors 87 ($z_1$, $z_2$, $z_3$) does not detect the presence of the sheet 15, then a decision is made that the relay condition of the sheet 15 is sub-standard, and the conveyor is moved slightly in the forward direction, or the push roller 58 is separated from the conveyor 46 by operating the pressurized actuator 60, and the sheet 15 is expelled from the spreading apparatus and out of the processing line.

With the invention as described in detail above, it is possible to move in a straight manner the lateral edge of a rectangular cloth piece in the pulling direction using a device which has a construction which is both simple and reasonably priced. Further, a process for realigning the lateral edge of the cloth piece becomes unnecessary, and it becomes possible to shorten the cycle for the process of spreading the cloth piece. Further, the lateral edge of the cloth piece can be held straight under an effective amount of tension. As a result, the occurrence of wrinkles is eliminated, and the finished quality of the cloth piece at the subsequent ironing process is improved.

Further, even when moving a rectangular cloth piece which has a large diagonal length onto the bench, the frictional resistance of the cloth piece is reduced due to the force from the air blowing out from the nozzles, provided near the concave shaped edge portion, to push up the cloth piece. Thus, it is possible to reduce the pulling motive power of the gripper. Further, the corner of the cloth piece which sticks out tail-like from the bench can be blown up to a specified position on the bench by the air blowing nozzle. Because there in no necessity to widen the width of the bench, the apparatus can be made smaller.

Further, with the present invention, even if a failure occurs in the spreading process of the rectangular cloth piece, the entire spread state of the cloth piece can be checked automatically with reliability both during spreading and after spreading, and a cloth piece which was not spread properly can be automatically expelled from the line during the process. By eliminating items spread in a manner which cannot be accepted, such troubles as the cloth piece becoming caught or entangled in the running devices disposed in the line or the processing equipment are eliminated. Thus, the subsequent processing of a badly spread item, which would be futile, is avoided, and good operational efficiency can be achieved.

We claim:

1. A cloth spreading apparatus comprising:

a bench having a sheet surface and said sheet surface having a sheet edge portion;

grip means for gripping a cloth piece and moving the cloth piece in a loading direction onto said sheet surface of said bench, said grip means moving the cloth piece to place an edge of the cloth piece on said sheet edge portion of said bench;

convex shaped edge portion positioned on said bench to spread open the cloth piece when the cloth piece is moved onto said sheet surface of said bench, said convex shaped portion is positioned upstream of said bench in said loading direction;

conveyor means mounted on said bench and for moving the cloth piece in an unloading direction, said unloading direction is substantially perpendicular to said loading direction, said sheet edge portion of said bench is positioned upstream on said bench in said unloading direction;

resistance means positioned in said sheet edge portion of said sheet surface and for applying resistance to the edge of the cloth piece as the cloth piece moves over said sheet surface of said bench, said resistance means includes a suction duct defining a plurality of suction holes in said sheet surface of said sheet edge portion of said bench, said resistance means removes folds and wrinkles in the cloth piece as the cloth piece moves across said sheet surface.

2. An apparatus in accordance with claim 1, wherein:

said grip means includes a first clip means for gripping a corner of the cloth piece, and also includes another clip means for gripping an edge of the cloth piece which includes the corner of the cloth piece;

said convex shaped portion applies contact resistance to the cloth piece as the cloth piece is moved by said grip means onto said sheet surface of said bench.

3. A cloth spreading apparatus for spreading rectangular cloth pieces according claim 1 further comprising:

a detection sensor positioned above and in a vicinity of a cloth intake opening of the bench for detecting an end edge of the cloth piece when an end edge portion of the cloth piece is passing through the intake opening; and a control device which receives a signal from the said sensor, calculates a timing for centering the cloth piece from a speed of advance of the gripper and from a timing of passage of the gripper and from that of the end edge of the cloth piece, and operates a grip release mechanism of the clips in the gripper.

4. A cloth spreading apparatus for rectangular cloth pieces according to claim 1, further comprising:

a roller which pushes a spreading side of the cloth piece placed at an end of the conveyor means and which runs in a horizontal direction perpendicular to the direction in which the cloth piece is pulled by said grip means;

a slit equipped with a downward-directed convex shaped spread plate which pulls by suction a center portion of the cloth piece which is hanging down from a conveyor end of the bench after the spreading side edge of the cloth piece is held between the end of the conveyor and the roller;

a push bar which pushes an upper portion of the cloth piece hanging down toward a spread relay conveyor provided underneath the bench; and a friction roller provided on a front side of the spread relay conveyor.

5. A cloth spreading apparatus for rectangular cloth pieces according to claim 1, further comprising:

a concave shaped front edge portion which is continuous with said convex shaped edge portion of a cloth piece intake portion of the bench;

a nozzle chamber attached to a frame of the spreading apparatus along a center line of the concave shaped front edge portion, wherein an upper surface of the nozzle chamber is in a same plane as said sheet surface of the bench and has a plurality of nozzle holes for blowing out air in an inclined upward direction along said loading direction of the cloth piece;

an air source for sending air to the nozzle chamber; and a guide plate for guiding a tail-like corner of the cloth piece which is blown up by air blown out from the nozzle holes into a specified position on the bench.

6. A cloth spreading apparatus for rectangular cloth pieces according to claim 1, further comprising:

at least two photoelectric sensors for detecting passage of the cloth piece which are disposed in a straight line above the conveyor means which runs in said unloading direction perpendicular to the loading direction;

a counter or timer disposed at a rotating portion of the conveyor means and which generates pulses for detecting a moving distance of the conveyor means;

a calculating means which calculates a plurality of specified positions of the cloth piece on the conveyor means by accepting signals from the plurality of photoelectric sensors to the counter or timer, and which finds a diagonal displacement of the rectangular cloth piece; and a control device which expels the cloth piece from the spreading apparatus by driving the conveyor means for a longer period of time that a prespecified time in case where the cloth piece is positioned diagonally beyond given permissible limits.

7. A cloth spreading apparatus for rectangular cloth pieces according to claim 1, further comprising:

at least two photoelectric sensors provided below a push roller and in a line parallel to the push roller for detecting the cloth piece when the cloth piece is held between the push roller and the conveyor means which runs in said unloading direction perpendicular to the loading direction, the conveyor means is stopped, and the cloth piece hangs down; and a control device which sends the cloth piece to a next process after a presence of the cloth piece has been confirmed by the photoelectric sensors, and which, when the presence of the cloth piece is not detected by any one of the photoelectric sensors, drives the conveyor means so as to expel the cloth piece from the spreading apparatus.

8. A cloth spreading apparatus comprising:

a bench having a sheet surface and said sheet surface having a sheet edge portion;

grip means for gripping a cloth piece and moving the cloth piece in a loading direction onto said sheet surface of said bench, said grip means moving the cloth piece to place an edge of the cloth piece on said sheet edge portion of said bench, said grip means includes a first clip means for gripping a corner of the cloth piece, and also includes another clip means for gripping an edge of the cloth piece which includes the corner of the cloth piece;

convex shaped edge portion positioned on said bench to spread open the cloth piece when the cloth piece is moved onto said sheet surface of said bench, said convex shaped portion applies contact resistance to the cloth piece as the cloth piece is moved by said grip means onto said sheet surface of said bench;

conveyor means mounted on said bench and for moving the cloth piece in an unloading direction;

resistance means positioned in said sheet edge portion of said sheet surface and for applying resistance to the edge of the cloth piece as the cloth piece moves over said sheet surface of said bench, said resistance means includes a suction duct defining a plurality of suction holes in said sheet surface of said sheet edge portion of said bench.

9. A cloth spreading apparatus comprising:

a bench having a sheet surface and said sheet surface having a sheet edge portion;

grip means for gripping a cloth piece and moving the cloth piece in a loading direction onto said sheet surface of said bench, said grip means moving the cloth piece to place an edge of the cloth piece on said sheet edge portion of said bench;

convex shaped edge portion positioned on said bench to spread open the cloth piece when the cloth piece is moved onto said sheet surface of said bench;

conveyor means mounted on said bench and for moving the cloth piece in an unloading direction;

resistance means positioned in said sheet edge portion of said sheet surface and for applying resistance to the edge of the cloth piece as the cloth piece moves over said sheet surface of said bench, said resistance means includes a suction duct defining a plurality of suction holes in said sheet surface of said sheet edge portion of said bench;

a concave shaped front edge portion which is continuous with said convex shaped edge portion of a cloth piece intake portion of the bench;

a nozzle chamber attached to a frame of the spreading apparatus along a center line of the concave shaped front edge portion, wherein an upper surface of the nozzle chamber is in a same plane as said sheet surface of the bench and has a plurality of nozzle holes for blowing out air in an inclined upward direction along said loading direction of the cloth piece;

an air source for sending air to the nozzle chamber; and a guide plate for guiding a tail-like corner of the cloth piece which is blown up by air blown out from the nozzle holes into a specified position on the bench.

* * * * *